United States Patent [19]

Chen et al.

[11] 4,015,778

[45] Apr. 5, 1977

[54] MULTIFUNCTIONAL FOLDING CHAIR

[76] Inventors: Helen Ho-Chiu Chen; David Wan-Ching Chen, both of B7, 640 W. 153 St., New York, N.Y. 10031

[22] Filed: Jan. 26, 1976

[21] Appl. No.: 652,340

[52] U.S. Cl. ..... 273/136 G; 273/136 K; 297/217

[51] Int. Cl.[2] ..... A63F 9/00

[58] Field of Search .... 273/136 R, 136 G, 136 GB, 273/136 K; 297/129, 217

[56] References Cited

UNITED STATES PATENTS

| | | | |
|---|---|---|---|
| 352,555 | 11/1886 | Merkel et al. | 273/136 K |
| 577,984 | 3/1897 | Horovitz | 273/136 K |
| 1,348,262 | 8/1920 | Brockway | 273/136 K |
| 2,075,354 | 3/1937 | Monier | 273/136 G |
| 2,095,482 | 10/1937 | Spicciato | 273/136 K |
| 3,001,843 | 9/1961 | Davis | 273/136 R |
| 3,077,327 | 2/1963 | Batie et al. | 297/217 |
| 3,139,281 | 6/1964 | Nicholson | 273/136 G |

FOREIGN PATENTS OR APPLICATIONS

| | | | |
|---|---|---|---|
| 21,322 | 9/1907 | United Kingdom | 273/136 R |

*Primary Examiner*—Richard C. Pinkham
*Assistant Examiner*—Harry G. Strappello

[57] ABSTRACT

A multifunctional outdoor folding chair comprising two generally U-shaped open frames, one major and outer and the other minor and inner, braced pivotally one within the other to support a detachable seat which, in turn, supports pivotally a detachable back panel. The two frames are braced at points generally midway between the ends of the paired cross legs thereof by a common fastener. Rows of bosses under the seat serve to connect with locking channels on the planar top portions of the two frames, and the chair height can be adjusted by choosing the appropriate boss row for connection with the major frame. A storage chamber is attached between the leg portions of the minor frame adjacent the lower ends, and another storage shelf is built onto the undersurface of the seat. The back panel, by means of angle joints at the rear end thereof, is mounted onto the seat through locking slits thereon. Different game board patterns are printed on the top of the seat, and on the back and the front of the back panel. Under the extended operative condition of the chair, an overlapping double seat is formed when the back panel is turned downward to fold upon the seat. To fold the chair, the double seat is disengaged from the major frame and folded upon the minor frame, and the overlapping complex of these three members is folded within the boundaries of the major frame in maximum compactness. Coinciding rectangular cutouts formed along one lateral side of the double seat provide a space for the adjacent leg pair to serve as a handle for carrying the folded chair.

5 Claims, 7 Drawing Figures

SHEET 1 OF 2

SHEET 2 OF 2

MULTIFUNCTIONAL FOLDING CHAIR

BACKGROUND OF THE INVENTION

From the consumers' point of view, outdoor folding chairs should ideally be light weight, foldable in minimum package, portable and composed of replaceable parts. Furthermore, since such chairs are meant to be used away from the conveniences of home, they should be multifunctional rather than just folding chairs. From the manufacturers' point of view, such chairs should be simple in design to reduce production and assembly costs, and they should also be of maximum stackability to minimize packaging, storage and transporting costs. Those folding chairs now commercially available do not meet all of these requirements.

SUMMARY OF THE INVENTION

One object of this invention is to build a light outdoor folding chair simple in design, easy to build and assemble, and replaceable with spare parts made of materials easily procurable and fabricated. To achieve this, metal tubings and durable plastics are used as building materials for the U-shaped major and minor frames, the seat, the back panel and the storage chamber braced or connected by separable locking means.

Another object of this invention is to build a portable outdoor folding chair of maximum compactness and stackability. Maximum compactness of the folded chair is accomplished by bracing a receded minor frame within the major frame to coincide with the rear edges thereof, providing more room beyond the frontal edges of the minor frame to accomodate the seat, the back rest and the storage chamber. For the folded chair to be carried by hand, a rectangular cutout is formed along one lateral edge of the back panel to coincide with another cutout on the corresponding part of the seat, providing a space for the adjacent leg pair to be grabbed as a handle.

The ultimate object of this invention is to build a multifunctional outdoor folding chair. Innovative features of this invention in this regard include storage provisions, game board patterns, and height adjustment and convertability of the chair, all accomplished without exceeding the space limit defined by the major frame. A storage chamber is mounted between the leg portions of the minor frame adjacent the lower ends, and another storage shelf is built onto the undersurface of the seat. Different game board patterns are printed on the top of the seat, and on the back and the front of the back panel. Chair height is adjusted by selecting one of three rows of seat bosses for connecting the seat with the major frame. The chair is converted into a stool with an overlapping double seat simply by folding the back panel over the seat; and if desired, the stool can serve as a small game table with a choice of three printed-in game board patterns on top.

The preferred embodiment of the invention is described hereinbelow and illustrated in the accompanying drawings, in which

DESCRIPTION OF THE PREFERRED EMBODIMENT

Figure 1:
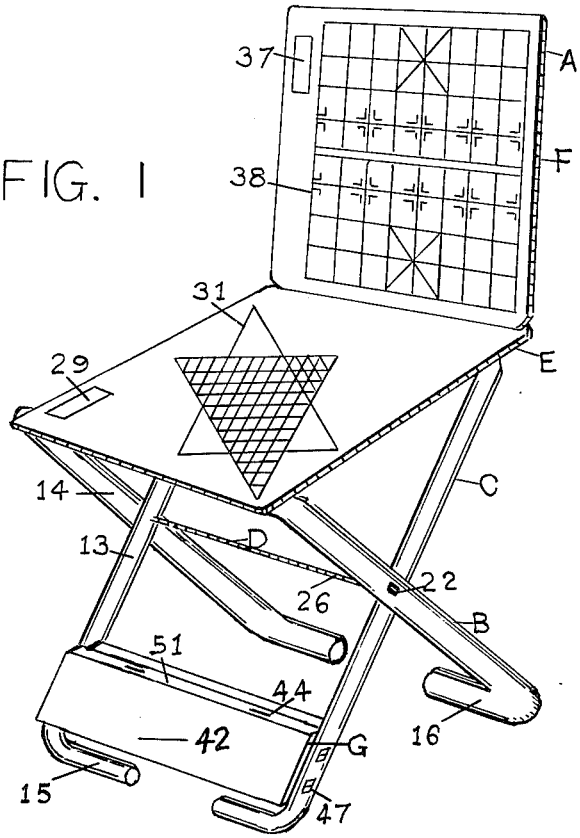
FIG. 1 is a perspective view of the folding chair of the invention fully extended.
Figure 2:
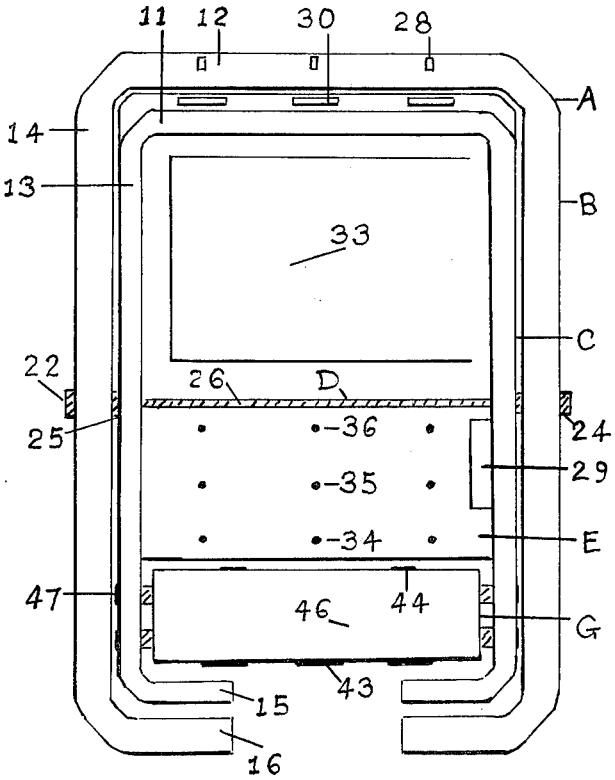
FIG. 2 is a bottom plan view of the chair of the invention fully folded.

Referring to FIGS. 1 and 2, the basic structure of chair A consists of two generally U-shaped open frames B and C, pivotally braced one within the other by a common fastener D, to support a detachable seat E which in turn supports a pivotally linked detachable back panel F. A storage chamber G is attached between the leg portions 13 of minor frame C and another storage shelf is built onto the undersurface of seat E. The members are so dimensioned that all other members are disposed within the boundaries of major frame B when folded, as will be described in detail hereinbelow.

The open frames B, C are made preferably of round, instead of flat, metal tubings. For obvious geometrical reasons, the use of round tubings means less building material needed in comparison with the use of flat tubings. Besides, the use of flat tubings, for stronger support of weight, is neither practical nor justified in this invention because chair A is height adjustable, and consequently, referring to FIGS. 1 and 6, contacts between planar ground portions 15, 16 and the ground and also between planar top portions 11, 12 and seat E will change. Therefore, inherently variable line to line contact offered by round tubings is preferred to surface contact by flat tubings which would require the design and making of special polygonal tubings. The seat E, back panel F and storage chamber G are made preferably of molded durable plastics. The fastener D is made of metal.

As shown in FIGS. 1 and 2, the two open frames B and C differ in height, width and depth; The minor frame C is comparatively shorter, narrower, smaller in diameter and preferably larger in wall thickness. The minor frame C supports the storage chamber G and the seat E, and the seat E in turn carries the storage shelf 33 and the back panel F. The major frame B, besides giving a support to the frontal end of seat E in operative condition of the chair, serves as a space provider taking up all other members within its roomy confine when chair A is compactly folded.

The open frames B, C are composed of three portions respectively: planar top portions 11, 12, leg portions 13, 14 and planar ground portions 15, 16. Both frames are bent to form incomplete rectangles with openings at the ground level, the ground portions 15, 16 being provided for a steadier ground support. The corners of frames B, C are rounded out, such that they fit each other when the two braced frames are folded one within the other.

Figure 3:
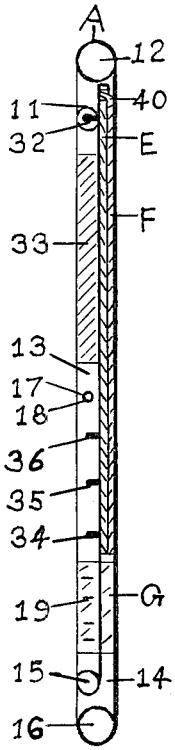
FIG. 3 is a lateral plan view of the chair of the invention fully folded as seen in FIG. 2.

Referring to FIG. 3, lateral holes 17, 18, round and identical in diameter, are formed on leg portions 13, 14 respectively to receive the common fastener D. Holes 17 on leg portions 13 of the minor frame C are formed slightly above midpoints between the ends thereof and at the centers of the horizontal plane thereof, but holes 18 on leg portions 14 of the major frame B are formed at points midway between the ends thereof and preferably toward the rear ends of the horizontal plane thereof, so that a larger space is created between planar top portions 11 and 12 to accomodate angle joints 40, and that as the two pivotally braced frames fold one within the other, the rear edges of these frames coincide to provide a larger space beyond the frontal edges of the receded minor frame C to accomodate seat E, back panel F and storage chamber G without any member protruding beyond the frontal edges of major frame B. Four short horizontal slots 19 are formed on each lateral side of leg portions 13 adjacent the lower ends for connecting with the storage chamber G.

Figure 4:
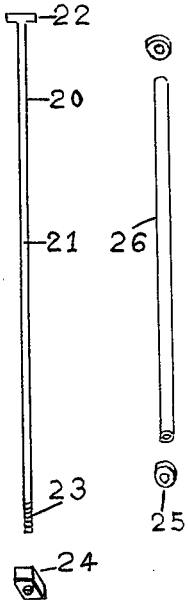
FIG. 4 is a detail view of components of the fastener used in bracing the paired cross leg portion of the chair of the invention.

The paired cross legs of open frames B, C are preferably braced pivotally by a transverse common fastener D to prevent lateral movement of leg portions 13, 14 and to maintain constant distance between the two frames when under pressure in use. Referring to FIG. 4, the fastener D is composed of the bolt 20 including a smooth, elongated shank 21 between the head 22 and the threaded end 23, a nut 24 threaded internally to fit the threaded end 23, two washers 25, and a straight exterior tubing 26 so dimensioned that the inner diameter thereof fits the bolt 20 snugly, the outer diameter thereof exceeds substantially the diameter of holes 17 on leg portions 13, and the length thereof equals the distance between the inner lateral edges of leg portions 13. The diameter of the bolt 20 matches holes 17 and 18 on leg portions 13 and 14.

The paired cross legs of frames B, C are pivotally braced with the transverse common fastener D by inserting the threaded end 23 of bolt 20 through a series of holes on chair legs and fastener parts, in the laterally successive order of leg portion 14, washer 25, leg portion 13, exterior tubing 26, the other leg portion 13, the other washer 25 and the other leg portion 14, as shown in FIG. 2, and finally connecting it with nut 24 to be tightened up; the extent of tightening being loose enough to permit free rotation of leg portions 13, 14 around the pivot bolt 20 but yet firm enough to prohibit leg portions 13, 14 from moving laterally along the fastener.

Figure 5:
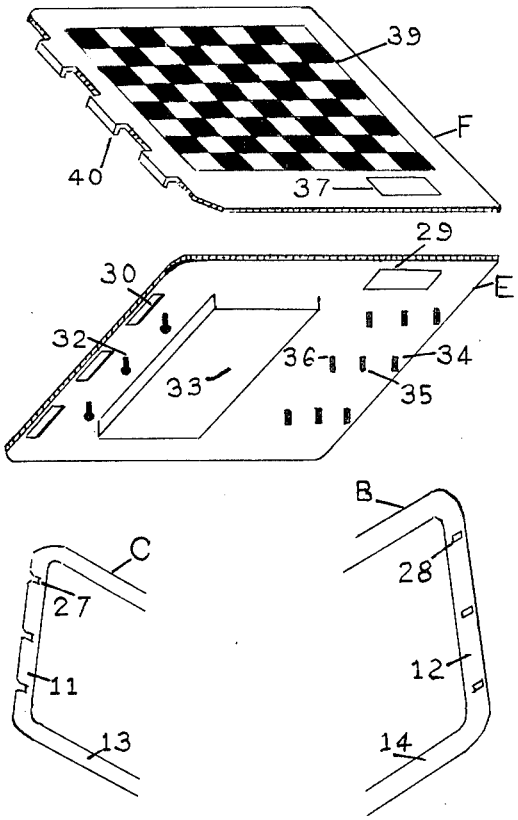
FIG. 5 is a perspective view of the back of the back panel, the undersurface of the seat, the frontal side of the upper portion of minor frame, and the rear side of the upper portion of major frame of the chair of the invention, members being positioned to show the interlocking devices thereon.

Referring to FIG. 5, three locking channels 27 are formed on the planar top portion 11 of minor frame C. These channels consist of enlarged round ends, equal in diameter and identical in location just behind the top of the planar portion 11, leading to perpendicular parts which cross over the top to run downward lengths, on the frontal side, less than one quarter of the circumference of planar top portion 11. The three channels are disposed in such manner that neighboring chammels are equally spaced between one another, and that the distance from one lateral channel to its neighboring leg portion 13 is exactly the same as the distance from the other lateral channel to its neighboring leg portion 13.

Three locking channels 28 are formed on the rear side of the planar top portion 12 of major frame B. These channels begin at the top of the planar portion 12 and run perpendicularly downward courses short of one quarter of the circumference of planar top portion 12. The three channels are equally spaced between one another, and the distance from one lateral channel to its neighboring leg portion 14 is exactly the same as the distance from the other lateral channel to its neighboring leg portion 14.

Referring to FIGS. 2 and 5, the seat E is a flat, generally rectangular panel, the width thereof approximates the width of minor frame C, and the length thereof reaches short of the lower edge of planar top portion 12 of major frame B at the top and also short of the top of storage chamber G at the bottom when both seat E and storage chamber G are mounted and chair A is fully folded. The upper corners of seat E are rounded out to fit the upper corners of major frame B.

Referring to FIGS. 1, 2 and 5, a rectangular cutout 29 is formed along one lateral side of seat E, such that the cutout 29 lies under the fastener D adjacent the inner lateral edge of leg portion 13 providing a space through which a leg pair 13, 14 of the folded chair A is grabbed in transport. Parallel to the rear edge of seat E are formed three locking slits 30, with widths substantially wider than the thickness of back panel F, which are equally sized for connecting with the back panel F. The locking slits 30 are equally spaced between one another and the distance from one lateral slit to its neighboring lateral seat edge is identical on both sides. A game board pattern 31 is printed on top of seat E.

Referring to FIG. 5, on the undersurface of seat E three perpendicular, short, solid bosses 32 or the like are formed inwardly parallel to locking slits 30 for connection with minor frame C. Bosses 32 consist of short, round bodies with enlarged round ends, so dimensioned that the enlarged boss ends match the enlarged round ends of the locking channels 27 on the planar top portion 11 and that the boss bodies match the straight parts of locking channels 27, and so spaced that bosses 32 settle to lock pivotally with channels 27 such that the lateral edges of seat E coincide with the outer lateral edges of minor frame C when the chair is folded. Inward bosses 32 is formed a storage shelf 33, for the storage of magazines and the like, which is walled on all sides except the one facing that lateral side of seat E with rectangular cutout 29. The storage shelf 33 is dimensioned to have a length shorter than the distance between the inner lateral edges of leg portions 13, a depth equaling the diameter of minor frame c, and a width such that the storage shelf 33 lies under the planar top portion 11 and above the pivot fastener D when seat E is folded over the minor frame C, as shown in FIGS. 2 and 3.

Referring back to FIGS. 2 and 5, three transverse rows of three short, perpendicular, round and solid bosses each, 34, 35, 36, or the like, are formed on the undersurface of seat E parallel to the frontal edge thereof. The vertical columns of these bosses parallel one another and the lateral edges of seat E, and are spaced to enable any transverse row of bosses, 34, 35 or 36, to connect with the identically spaced locking channels 28 on the major frame B after seat E has been locked with minor frame C at the opposite end.

Figure 6:
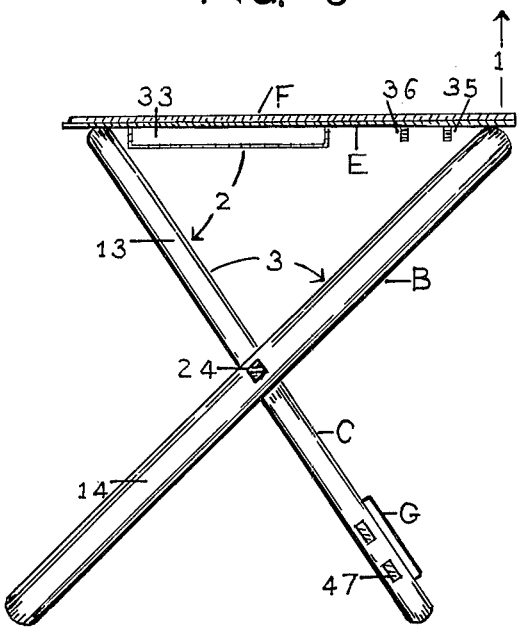
FIG. 6 is a side view of the stool of the invention fully extended with an overlapping double seat; arrows 1, 2, 3 show the consecutive moving directions of members in the folding act.

In its operative open position as seen in FIGS. 1 and 6, the height of chair A is determined by the particular row of bosses, 34, 35 or 36, selected for connecting with major frame B. Thus, the use of boss row 34 results in large leg spread and small chair height, the use of row 35 gives moderate leg spread and moderate chair height, while the use of boss row 36 gives the smallest leg spread, and a high height which, being not very stable, is recommended only for chess playing or the like, depending on the choice of three game board patterns printed on the top of seat E, and on the front and the back of back panel F. As the connection with major frame B switches from the boss row 34 to row 35 and finally to row 36, the angles between seat E and planar top portions 11,12 and between planar ground portions 15,16 and the ground become less and less acute, and the perpendicular forms of locking channels 27 and 28 permit the boss rows at both ends to slide therein allowing the cylindrical top portions 11 and 12 to make changing line to lne contact with seat E and allowing the cylindrical ground portions 15 and 16 to make changing line to line contact with the ground.

To fold the chair, seat E is detached from major frame B and folded over minor frame C, which is then folded within major frame B. In a folded chair, the boss row 34, 35 and 36 remain within the rear edges of frames B and C, as shown in FIG. 3.

Referring back to FIG. 5, the back rest F is a flat, nearly square panel formed generally like seat E, being as wide and thick but not as long as seat E, so that the two mambers coincide on all sides except the connecting side when they are folded upon each other. On one lateral side of the back panel F is formed a rectangular cutout 37, as large as the rectangular cutout 29 on seat E, so disposed that when seat E and back panel F are linked and folded surface to surface the rectangular cutouts 37 and 29 coincide with each other. Game board patterns 38 and 39, different from each other and from the pattern 31 on top of seat E, are printed on the front and on the back of panel F, as seen in FIGS. 1 and 5.

Referring to FIG. 5, from the rear end of back panel F extend three short angle joints 40 including coplanar extension parts, as thick as the back panel itself and slightly longer than the thickness of seat E, which bend, at angles of about 100° to the planar surface of back panel F, into parts the length of which equal the combined thickness of seat E plus back panel F. The back panel F is mounted pivotally, and also detachably, onto seat E by inserting the bent parts of angle joints 40 through the matching slits 30 and then turning them inward to fold under seat E behind the planar top portion 11. Thus the back panel F is mounted on its flat end at an angle of about 100° to seat E, as shown in FIG. 1. Our invention described hereinabove is inherently a triad of a chair, a stool and a game table, since chair A is quickly converted into a stool by folding the back panel F over seat E to form an overlapping double seat as seen in FIG. 6, and the stool, in turn, quickly becomes a small game table, with a choice of three printed-in game board patterns 31, 38 or 39 on top, after switching to boss row 36 for connecting with major frame B to attain a greater playing height.

Figure 7:
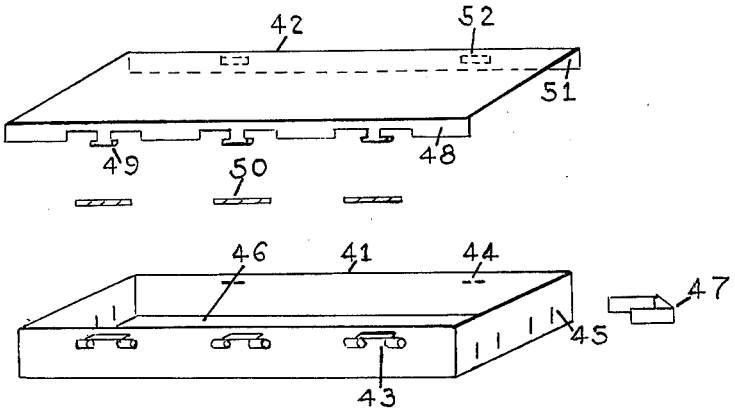
FIG. 7 is a perspective view of components of the storage chamber mounted on the chair of the invention as seen in FIGS. 1 and 2.

Referring to FIG. 7, the storage chamber G comprises the chamber body 41 and the cover 42, both preferably molded of durable plastics. the chamber body 41 is in the form of a shallow, generally rectangular box, the length thereof being slightly shorter than the distance between the inner lateral edges of minor frame C, and the depth thereof being slightly shorter than the diameter of major frame B. Along the top edge on one elongated side of chamber body 41 are formed halves of T hinges 43, or the like, each composed of two hollow cylinders connected to the chamber body by a common base. Two slightly raised perpendicular snap locks 44, or the like, are formed along the top edge of the other elongated side of chamber body 41.

Four short slots 45 are formed on each of the short sides of chamber body 41 perpendicular to the bottom 46. Slots 45 are dimensioned and spaced as slots 19 on minor frame C in such manner that when the storage chamber G, with its hinge side down, is tightly mounted between the leg protions 13 by connecting slots 45 and slots 19 with U-shaped metal bands 47, the hinge side of storage chamber G lies just above the ground portions 15, the bottom 46 thereof coincides with the rear edges of the leg portions 13 and the ground portions 15, and the cover 42 thereof protrudes beyond the frontal edges of the leg portions 13 and the ground portions 15, as shown in FIG. 1. Under the extended operative condition of chair A as seen in FIG. 1, contents such as chess box and the like will not easily drop out of the storage chamber G when it is opened, because the chamber body 41 is slanted with bottom side 46 down.

The flat cover 42 is shaped generally like the chamber body 41, but it is slightly longer and wider. It has two perpendicularly downward rims, with one of which, rim 48, truncated to accomodate the halves of T hinge 49, or the like. Hinge halves 49 are hollow cylinders connected to the truncated rim bases of rim 48, and are positioned and spaced to fit the other hinge halves 43 on the chamber body 41. The two halves of each T hinge are pivotally connected by a hinge pin 50, the diameter thereof fits the inner diameter of the cylinder on hinge half 49 but is smaller than the inner diameter of the two cylinders on hinge half 49, and the length thereof equals the length of the three cylinders combined.

On the rim 51 of cover 42 are formed two key-hole slots 52, or the like, dimensioned and spaced to lock with the matching snap locks 44 on chamber body 41. With the other side already hingedly connected, the storage chamber G is snap locked by directing the cover 42 downward, lifting the rim 51 and then releasing it when key-hole slots 52 and snap lock 44 are aligned in locking positions. To unlock, the procedure is reversed.

When chair A is fully folded, as seen in FIG. 3, the storage chamber G borders short of the seat E and the back panel F on top and the ground portions 15 at the bottom, while coincides with the frontal and rear edges of the major frame B.

While specific embodiments of this invention have been described herein, it will be understood that full use may be made of modifications, substitutions and equivalents without departing from the spirit as well as the scope of our invention.

We claim as our invention:

1. A multifunctional, height adjustable folding chair comprising:

two generally U-shaped open frames, one outer and major and the other inner and minor, with perpendicular locking channels formed on the planar top portions thereof and horizontal slots formed adjacent the lower ends of the leg portions of said minor frame, braced one within the other by a transverse common fastener through lateral holes formed at points generally midway between the ends of the paired legs of said chair;

a flat, generally rectangular seat, which has a game board pattern printed on the top, three locking slits formed adjacent the rear end, a rectangular cutout formed on one lateral side and a storage shelf built onto the undersurface, connected pivotally and detachably at the rear end by a transverse row of bosses on its undersurface to said minor frame through said locking channels thereon, and connected detachably at the frontal end by a choice of three transverse rows of bosses on its undersurface to said major frame through said locking channels thereon, in the extended operative condition of said chair;

a flat, nearly square back panel, which has game board patterns printed on the back and the front thereof different from each other and from said pattern on said seat, and also has a rectangular cutout on one lateral side to correspond with said rectangular cutout on said seat, connected pivotally and detachably by three angle joints at the rear end thereof to said seat through said locking slits thereon;

a rectangular storage chamber mounted between said leg portions of said minor frame adjacent the lower ends thereof through said slots thereon; members being dimensioned to fit one another, such that in switching from the extended position of said chair to the folded position, said back panel is folded over said seat which is then disengaged from the top of said major frame and folded over said minor frame which in turn is folded along with all other members within the boundaries of said major frame.

2. The chair as defined in claim 1 wherein said lateral holes on said leg portions of said minor frame are formed slightly above midpoints between the ends thereof and at the centers of the horizontal plane thereof, but said lateral holes on said leg portions of said major frame are formed at points midway between the ends thereof and toward the rear ends of the horizontal plane thereof, to receive said common fastener, creating a receded said minor frame to coincide with the rear edges of said major frame and to provide a larger space beyond the frontal edges of said minor frame to accomodate said seat, said back panel and said storage chamber without any of these members protruding beyond the frontal edges of said major frame when said chair is folded.

3. The chair of claim 1 wherein said transverse row of bosses is formed inward said locking slits parallel to the rear edge of said seat, said three transverse rows of bosses are formed parallel to one another and to the frontal edge of said seat, and the height of said chair is adjusted by selecting one of said three rows of bosses for connecting said seat with said major frame after said seat has already been locked by said row of bosses at the rear end with said minor frame.

4. The chair of claim 1 wherein said angle joints comprising coplanar extension parts and bent parts are formed on the rear edge of said back panel, said locking slits are formed parallel to the rear edge of said seat, and when said back panel is linked onto and folded over said seat, under the extended operative condition of said chair, a double seat is formed coinciding on all sides except the connecting side.

5. The chair of claim 1 wherein said rectangular cutout on said back panel coincides with said rectangular cutout on said seat to provide a space through which the adjacent leg pair of said folded chair can be grabbed by hand in transport.

* * * * *